United States Patent [19]

Hirata et al.

[11] 4,014,445

[45] Mar. 29, 1977

[54] CATHODE PLATE TRANSFER APPARATUS

[75] Inventors: Toshinori Hirata; Takahiro Kikkawa, both of Gifu, Japan

[73] Assignee: Mitsui Mining & Smelting Co., Ltd., Tokyo, Japan

[22] Filed: Mar. 15, 1976

[21] Appl. No.: 666,946

[30] Foreign Application Priority Data

Mar. 18, 1975 Japan ..... 50-32606
Mar. 18, 1975 Japan ..... 50-32607

[52] U.S. Cl. ..... 214/89
[51] Int. Cl.² ..... B65G 47/52
[58] Field of Search ..... 214/89; 134/76

[56] References Cited

UNITED STATES PATENTS 2,738,888 3/1956 Todd et al. ..... 214/89
3,887,094 6/1975 Ikeda et al. ..... 214/89

*Primary Examiner*—Robert G. Sheridan
*Attorney, Agent, or Firm*—Woodhams, Blanchard and Flynn

[57] ABSTRACT

An apparatus for transferring cathode plates, which comprises the first and the second conveyers having a sufficient stock capacity for a plurality of cathode plates arranged at regular intervals and a shifting means installed between said first conveyer and second conveyer for the purpose of transferring the cathode plates by a required quantity thereof from the first conveyer to the second conveyer, thereby rendering it possible to perform the supply and the discharge of cathode plates stably at all times without being affected by the fluctuations of the quantity of cathode plates on both conveyers through the control of the operation of the first and the second conveyers as well as the shifting means.

2 Claims, 7 Drawing Figures

CATHODE PLATE TRANSFER APPARATUS

BACKGROUND OF THE INVENTION a. Field of the Invention

The present invention relates to a cathode plate transfer apparatus for the purpose of forwarding a bunch of cathode plates to be used in the nonferrous metal electrolytic refinery, e.g., cathode plates pulled out of an electrolytic cell, one by one at regular intervals continuously to the process for peeling off the electrodeposited metal plate attached to the cathode plate, or composing the cathode's base plates after peeling off the electrodeposited metal plate so as to be arranged at regular intervals suited for setting in the electrolytic cell upon receiving said cathode's base plates.

b. Description of the Prior Art

Nowadays, with the mechanization of the electrodeposited metal plate peeling-off work in the nonferrous metal electrolytic refinery, there is a cry for the mechanization of the cathode plate transferring work before and after said peeling-off work.

However, as regards the cathode plate transferring work on the occasion of forwarding the cathode plates pulled out of, for instance, an electrolytic cell to the electrodeposited metal plate peeling-off process, the quantity of cathode plates to be supplied sheerly varies with the conditions on the part of the electrolytic operation, while the quantity of cathode plates to be discharged sheerly varies with the conditions on the part of the peeling-off process. Accordingly, as for the cathode plate transfer apparatus, it is not only required to be capable of filling quite different kinds of functions, namely, the function of receiving cathode plates according to the conditions of the electrolytic cell and the function of sending out cathode plates according to the condition of the peeling-off process, but also required to be capable of filling the function of sufficiently absorbing the fluctuations of the quantity of in-coming cathode plates and the quantity of out-going cathode plates free of interference of such fluctuations. However, there has not yet been proposed any cathode plate transfer apparatus to meet these requirements satisfactorily. The same situation as above is perceived with respect to the cathode plate transfer mechanism for returning the cathode's base plate after peeling off the electrodeposited metal plate to the electrolytic cell as well.

SUMMARY OF THE INVENTION

The object of the present invention is to provide a cathode plate transfer apparatus which comprises the first and the second conveyors having a sufficient stock capacity for a plurality of cathode plates arranged at regular intervals and a shifting means installed between said first conveyor and second conveyor for the purpose of transferring the cathode plates by a required quantity thereof from the first conveyor to the second conveyor, thereby rendering it possible to perform the supply and the discharge of cathode plates stably at all times without being affected by the fluctuations of the quantity of cathode plates on both conveyors through the control of the operation of the first and the second conveyors as well as the shifting means.

DESCRIPTION OF THE PREFERRED EMBODIMENTS

Referring to the appended drawings.

Figure 1:
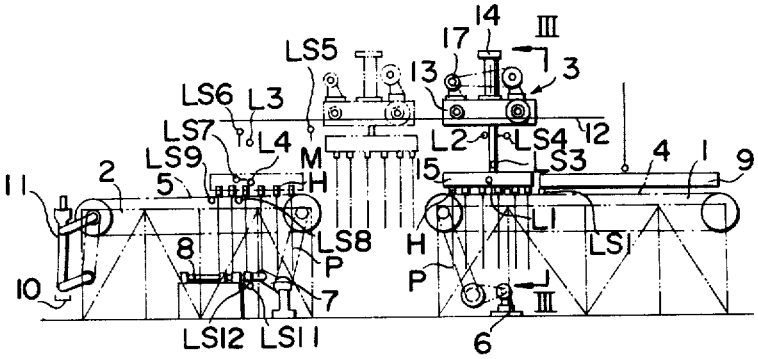
FIG. 1 is a front view of an apparatus according to the present invention for the purpose of forwarding the cathode plates with electrodeposited metal plate to the peeling-off process.
Figure 2:
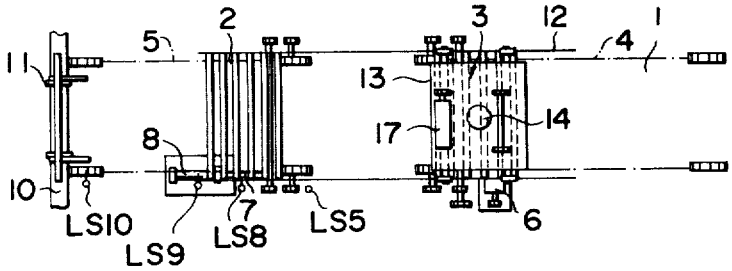
FIG. 2 is a plane figure of the same apparatus as shown in FIG. 1.
Figure 3:
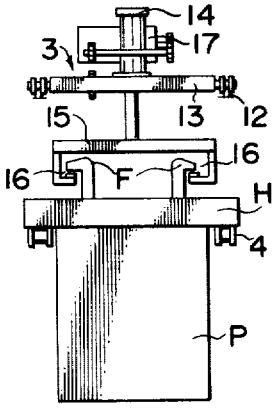
FIG. 3 is a side view — on an enlarged scale — taken along the line III—III of FIG. 1.

Now, in FIGS. 1, 2 and 3, the reference numeral 1 denotes the first conveyor, 2 denotes the second conveyor so disposed as to make its rear end confront the fore end of said first conveyor, and 3 denotes a shifting means which travels between a position above the cathode plate discharging position in the fore end portion of said first conveyor 1 and a position above the cathode plate supplying position in the rear end portion of said second conveyor 2. Both the first and the second conveyors 1, 2 are equipped with a pair of roller chains 4, 5 for the purpose of suspending and shifting the cathode plate P with the aid of a head bar H. The first conveyor 1 is appropriately driven by a motor 6, while the second conveyor 2 is supposed to be driven intermittently at regular intervals by means of a cylinder 8 connected to a ratchet mechanism. Above the rear end portion of the first conveyor 1 is disposed a hoist 9 for the purpose of pulling up a bunch of cathode plates consisting of a plurality of cathode plates arranged at regular intervals from an electrolytic cell not shown in the drawings and putting them on the first conveyor 1, while in the vicinity of the fore end portion of the second conveyor 2 is provided a shifter 11 to be driven by a motor not shown in the drawings for the purpose of taking out the cathode plates one by one from the second conveyor 2 and transferring them onto a cross-feed conveyor 10.

The shifting means 3 is equipped with a truck 13 which travels on the rails 12 installed between above the cathode plate discharging position in the fore end portion of the first conveyor 1 and above the cathode plate supplying position in the rear end portion of the second conveyor 2. The lower part of this truck 13 is equipped with a hanger 15 which is connected to a cylinder 14 and is supposed to move along the route L1 L2 ML3 L4 L1 shown in FIG. 1 in concert with the travel of the truck 13. The hanger 15 is provided with a pair of grooves 16 formed along both sides of its lower part, said grooves being devised to engage with the hook F of the cathode plate P as illustrated in FIG. 3. The reference numeral 17 denotes a motor for driving the truck 13.

As to the number of cathode plates to be put on the first and second conveyor 1, 2 and the number of cathode plates to be suspended by the shifting means 3, in the case of the present embodiment, as the number of cathode plates to be suspended by the hoist 9 at a time is half the number of cathode plates to be placed in the electrolytic cell, by appropriately determining the length of the respective conveyors 1, 2 and the length of the hanger 15 of the shifting means 3, it is set at the number of cathode plates to be suspended by the hoist 9 at a time plus more than the number of cathode plates to be suspended by the shifting means 3 at a time as regards the first convey 1, while as regards the second conveyor 2, it is set at several times as many as cathode plates to be suspended by the shifting means 3 at a time, and as regards the shifting means 3, it is set at half the number of cathode plates to be suspended by the hoist 9, that is, one fourth of the number of cathode plates to be placed in the electrolytic cell. As to the number of cathode plates to be put on the first and the second conveyor 1, 2 and the number of cathode plates to be suspended by the shifting means 3, it is not particularly limited: in the case of the first conveyor 1, it suffices to set the number so as to render it possible to absorb the fluctuations of the quantity of cathode plates to be supplied arising from the conditions of the operation of electrolysis sufficiently, and in the case of the second conveyor 2, it suffices to set it so as to absorb the fluctuations of the quantity of cathode plates to be discharged arising from the conditions of peeling-off process as well as the fluctuations of the quantity of cathode plates to be transferred from the first conveyor 1 sufficiently.

Figure 4:
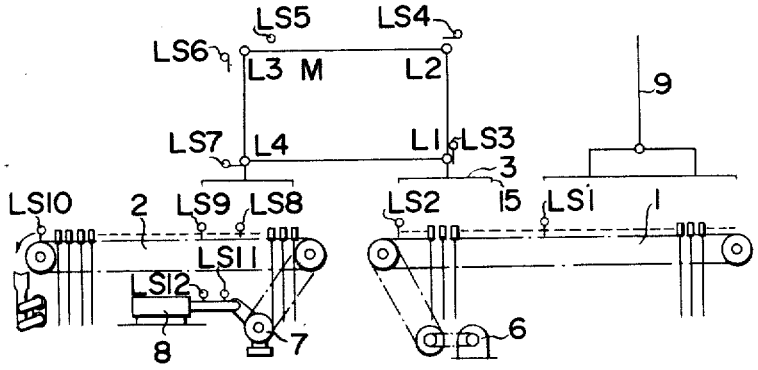
FIG. 4 is a diagram illustrative of the arrangement of limit switches for the purpose of automatically operating the apparatus of the present invention.

Next, the mode of operation of the present embodiment will be explained in the following on the basis of the diagram of arrangement of limit switches shown in FIG. 4.

Let it supposed that a bunch of cathode plates consisting of half the number of cathode plates arranged at regular intervals in an electrolytic cell are pulled out of said electrolytic cell, carried to the rear end portion of the first conveyor 1 and put on the roller chain 4 of the first conveyor 1 as they are with the aid of the head bar H. Then, the limit switch LS1 senses this, and the motor 6 is actuated to drive the first conveyor 1, whereby the bunch of cathode plates advance. By this time, the hanger 15 descends to the cathode plate discharging position in the rear end portion of the first conveyor 1 from the shifting means 3 which is in abeyance at the terminum of its retreat above said discharging position, and assumes the posture of standing by. The cathode plate P advanced along the first conveyor 1 moves on upon having their hooks F engaged with the groove 16 of the hanger 15, and when they arrive at the terminum of advance, the limit switch LS2 senses this, the motor 6 stops to bring the first conveyor 1 to a halt thereby to confirm the hanger 15 is in the state of being capable of holding a prescribed number of cathode plates P within its groove 16, the cylinder 14 is actuated, the hanger 15 is elevated and the cathode plates P are suspended. When the hanger 15 reaches to the terminum of ascent L2, the limit switch LS4 senses this, the cylinder 14 is stopped and the hanger 15 is brought to a halt: besides, if the cathode plates P have been sensed by the limit switches LS8, LS9 of the second conveyor 2 on this occasion, the hanger 15 stands by at said terminum of ascent L2 until the limit switch LS8 no longer senses the cathode plates P, and the limit switch LS9 senses the cathode plates P. When the limit switch LS8 no longer senses the cathode plates P, the motor 17 is actuated to advance the truck 13. When the truck 13 reaches to the middle point M and the limit switch LS5 senses this, the motor 17 is stopped to bring the truck 13 to a halt, and the truck 13 stands by at said middle point M until the limit switch LS9 no longer senses the cathode plates P. When the rearmost cathode plate P of the bunch of cathode plates on the second conveyor 2 passes the limit switch LS9 and said limit switch LS9 no longer senses the cathode plates P, the motor 17 for the truck 13 is actuated to advance the truck 13. During a time equivalent to the time required for the advance of the rearmost cathode plate by a prescribed distance after said cathode plate has passed the limit switch LS9, the truck 13 is moved up to the terminum of advance L3, and the limit switch LS6 senses this, stops the motor 17 to bring the truck 13 to a halt and also actuates the cylinder 14 thereby to make the hanger 15 descend. And, the suspended bunch of cathode plates are put on the cathode plate supplying position of the second conveyor 2 to see that the foremost cathode plate P be disposed at a prescribed distance behind the rearmost cathode plate P on the foregoing conveyor. The hanger 15 further descends, and at the time when the hook F of cathode plate P is disengaged from the groove 16 of the hanger 15, the hanger reaches to the terminum of descent L4. When the limit switch LS7 senses this, it stops the cylinder 14 to bring the hanger 15 to a halt.

After a prescribed space of time, the motor 17 is actuated reversely, and the truck 13 is made to retreat while disengaging the hook F from the hanger 15 which is left at the terminum of descent. As for the first conveyor 1, at the time when the truck 13 is sensed to have reached to such a position as will not impede the progress of the first conveyor 1 by the limit switch LS5 at the middle point M on the route of its advance, the first conveyor 1 is again operated to advance the remaining half of cathode plates P and stand by at the terminum of advance in the state of having been sensed by the limit switch LS2. Besides, on the rear end of the first conveyor 1, there is a succeeding bunch of cathode plates pulled out of the electrolytic cell and put thereon by the hoist 9.

Accordingly, with the retreat of the truck 3 along the first conveyor 1, the hanger 15 is applied intact to the cathode plates P placed at the discharging position, and when the truck 13 reaches to the terminum of retreat, the limit switch LS3 senses this and stops the motor 17 to bring the truck 13 to a halt: besides, if the cathode plates P have been sensed by the limit switch LS2, the cylinder 14 is again actuated to suspend the cathode plates P and the same operation as described in the foregoing is repeated.

Meanwhile, the foremost cathode plate P of a bunch of cathode plates transferred onto the second conveyor 2 from the hanger 15 is sensed by the limit switch LS9, while several cathode plates following thereto are sensed by the limit switch LS8.

A series of plural number of cathode plates P arranged at regular intervals on the second conveyor 2 are sensed by the limit switch LS10 when they are shifted one at a time onto the crossfeed conveyor 10 from the shifter 11 driven by a motor not shown in the drawings, and with the reciprocating motion of the cylinder between the limit switches LS11, LS12 and intermittent driving of the second conveyor 2 at regular intervals through the ratchet mechanism 7, the cathode plates P are advanced at regular intervals.

Inasmuch as the apparatus of the present invention is devised as above, when the first conveyor 1 receives a bunch of cathode plates consisting of plural cathode plates arranged at regular intervals, the first sensor senses this and actuates the first conveyor 1: when the bunch of cathode plates suspended by a hanger reaches to the cathode plate discharging position, the second sensor senses this and actuates the hanger suspending the bunch of cathode plates; the third sensor senses the passage of the rearmost cathode plate of the bunch of cathode plates put on the second conveyor through the cathode plate supplying position, advances a shifting means in a space of time equivalent to the time required for advancing said rearmost cathode plate by a prescribed distance after passing the cathode plate supplying position and actuates the hanger, whereby the suspended cathode plates come to be mounted on the second conveyor at the supplying position thereof to see that the foremost cathode plate be positioned at a prescribed distance behind said rearmost cathode plate, while the cathode plates on the first conveyor can be put on the second conveyor by a shifting means so as to be always positioned at a prescribed distance behind the rearmost cathode plate thereon regardless of the timing for actuation of the second conveyor; a plurality of cathode plates can be always arranged at regular intervals on the second conveyor; and the discharge of cathode plates from the second conveyor is very stabilized. That is, application of the present invention on the occasion of transferring cathode plates from the electrolytic cell to the electrodeposited metal plate peeling-off process will bring on a superb operational effect such that the fluctuations of the quantity of cathode-plates-to-be-transferred arising from the conditions on the part of the operation of electrolysis and the conditions of the peeling-off process can be simply absorbed without making them interfere with each other, thereby rendering it possible to perform the cathode plate transferring operation stably and accurately.

Figure 5:
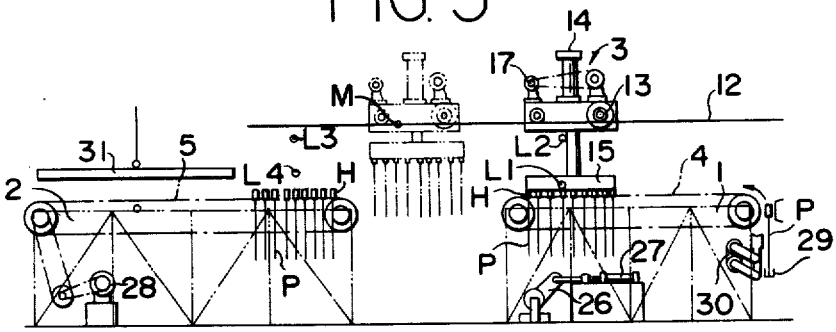
FIG. 5 is a front view of an apparatus according to the present invention for the purpose of sending the cathode plates after peeling off the electrodeposited metal plate into an electrolytic cell.
Figure 6:
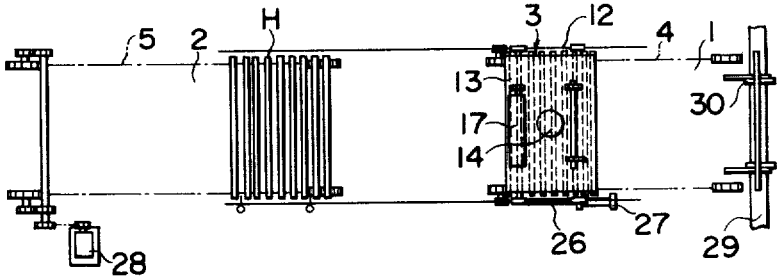
FIG. 6 is a plane figure of the same apparatus as shown in FIG. 4.

Next, the apparatus for supplying cathode plates to the electrolytic cell in the present invention will be explained in the following. FIGS. 5 and 6 are illustrative of an embodiment of said apparatus, wherein the construction is the same as that of the apparatus in FIG. 1 save for the mechanism for supplying cathode plates to the first conveyor 1 and the mechanism for discharging cathode plates from the second conveyor 2. Therefore, the explanation hereunder will be made with respect to the points of difference exclusively.

Both the first and the second conveyor 1, 2 are equipped with a pair of roller chains 4, 5 for the purpose of loading a head bar H for cathode plates P, and the first conveyor 1 is supposed to be intermittently driven by a cylinder 27 connected thereto through a ratchet 26, while the second conveyor 2 is supposed to be appropriately driven by a motor 28.

At the rear end of the first conveyor 1 is disposed a crossfeed conveyor 29 to meet at right angles therewith, and the cathode plates P are supposed to be transferred from said crossfeed conveyor 29 onto the first conveyor 1 one at a time by the shifter 30 driven by a motor not shown in the drawings. A hoist 31 is disposed above the second conveyor 2, and by means of this hoist 31, a bunch of cathode plates arranged on the second conveyor 2 are suspended and carried to be returned to the electrolytic cell.

The mechanism of the shifting means for transferring the cathode plates from the first conveyor 1 to the second conveyor 2 and the mode of operation thereof are quite the same as that of the apparatus shown in FIGS. 1 and 3.

Referring to the number of cathode plates to be put on the first and the second conveyor 1, 2 and the number of cathode plates to be suspended by the shifting means 3, in the case of the present embodiment, as regards the number of cathode plates to be put on the first conveyor 1, it is set at the number of cathode plate to be suspended by the shifting means 3 at a time at the least, while as regards the number of cathode plates to be put on the second conveyor 2, it is set at the number of cathode plates to be suspended by the hoist 31 at a time plus more than the number of cathode plates to be suspended by the shifting means 3 at a time, and the number of cathode plates to be suspended by said hoist 31 at a time is set at half the number of cathode plates to be placed in the electrolytic cell while the number of cathode plates to be suspended by said shifting means 3 at a time is set at one quarter of the number of cathode plates to be placed in the electrolytic cell. As to the number of cathode plates to be put on the first and the second conveyor 1, 2 and the number of cathode plates to be suspended by the shifting means 3, it is not particularly limited: in the case of the first conveyor 1, it suffices to set the number so as to render it possible to absorb the fluctuation of the quantity of cathode plates to be conveyed arising from the conditions of the electrodeposited metal plate peeling-off process sufficiently, and in the case of the second conveyor 2, it suffices to set the number so as to render it possible to absorb the fluctuations of the quantity of cathode plates to be conveyed arising from the conditions on the part of the operation of electrolysis as well as the fluctuations of the quantity of cathode plates to be transferred from the first conveyor 1 sufficiently.

Figure 7:
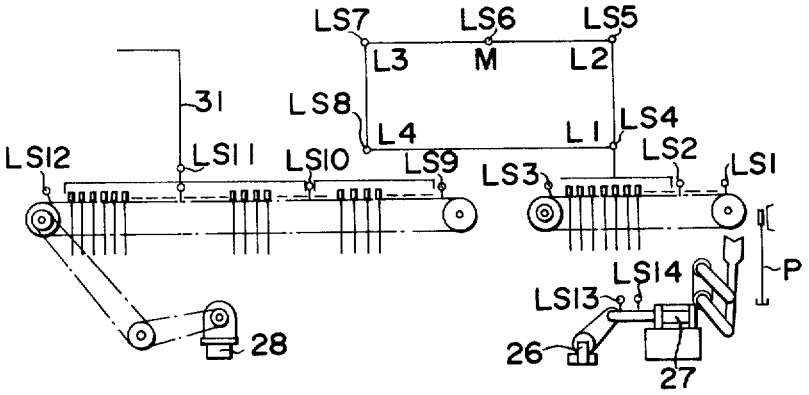
FIG. 7 is a diagram illustrative of the arrangement of limit switches for the purpose of automatically operating the apparatus shown in FIG. 5.

Next, the mode of operation of the present embodiment will be explained in the following on the basis of the diagram of arrangement of limit switches shown in FIG. 7.

When the cathode plate P after peeling off the electrodeposited metal plate is transversely conveyed one by one along the crossfeed conveyor 29 shown in FIGS. 5 and 6 and reaches to the position confronting the rear end portion of the first conveyor 1, it is sensed by the shifter 30 driven by a motor not shown in the drawings and is shifted thereby one at a time onto the first conveyor 1. When the cathode plate P is thus shifted onto the first conveyor 1, the limit switch LS1 senses this, the cylinder 27 reciprocates between the limit switches LS13 and LS14 thereby to drive the first conveyor 1 intermittently by means of the ratchet mechanism 26 and advance the cathode plate P by a prescribed distance (a distance equivalent to 1 pitch). When the cathode plate P in the course of advance as above is sensed by the limit switch LS2, an electromagnetic valve not shown in the drawings is actuated, washing water or hot water is dashed over both sides of the cathode plate P for a prescribed time whereby washing is carried out. When the next cathode plate P is shifted onto the first conveyor 1 by said shifter 30 likewise, the first conveyor 1 is again driven, advances said cathode plate P by a distance equivalent to one pitch, and through repetition of this operation, plural number of cathode plates P are continuously arranged on the first conveyor 1 at regular pitch. Meanwhile, above the cathode plate discharging position in the fore end portion of the first conveyor 1, there stops the truck 13, and the hanger 15 stands by at the terminum of its descent and in the state of being in contact with the limit switch LS4 at the terminum of its retreat, while the groove 16 thereof fronts on the region of movement of the hook F of the cathode plate P. And, when said hook F of the cathode plate P advancing along the first conveyor 1 nears the fore end portion of the first conveyor 1, it passes along the inside of the groove 16 of the hanger 15. When the foremost cathode plate P reaches to the terminum of advance of the first conveyor 1, the limit switch LS3 senses this, the state of the hanger 15 permitting suspension of a prescribed number of cathode plates is confirmed, the cylinder 27 is brought to a halt, the first conveyor 1 is stopped, and if the limit switch LS10 on the second conveyor 2 has sensed any cathode plate P, the hanger 15 stands by thereat; if the limit switch LS10 has not sensed any cathode plate P, the cylinder 14 of the shifting means 3 is actuated, the hanger 15 is elevated and suspends a bunch of cathode plates consisting of a plurality of cathode plates arranged at regular intervals, and when said hanger 15 reaches to the terminum of ascent, the limit switch LS5 senses this, stops the cylinder 14 to bring the hanger 15 to a halt and drives the motor 17 immediately thereby to advance the truck 13. When the truck 13 in the course of its advance is sensed by the limit switch LS6, the arrival of the truck 13 at such a position as will not impede the driving of the first conveyor 1 for advance thereof is confirmed, and the first conveyor 1 is driven intermittently each time a cathode plate is received from the shifter 30.

When the truck 13 further advances to arrive at the terminum of its advance L3, the limit switch LS7 senses this, the motor 17 is stopped, the truck 13 is brought to a halt, and also the second conveyor 2 being in abeyance is confirmed, the cylinder 14 is then actuated to make the hanger 15 descend, the hanger 15 further descends after suspending the head bar H for cathode plate P above the second conveyor 2 and reaches to the terminum of its descent L4, and when the limit switch LS8 senses this, the cylinder 14 is brought to a halt and the hanger 15 is stopped. At this stage, the cathode plate P is in the condition of being put on the second conveyor 2 and the hanger 15 is in the condition of being relieved of the burden of cathode plate P. After a prescribed space of time, the motor 17 for the truck 13 is actuated, the truck 13 retreats while leaving the hanger 15 at the terminum of descent thereof, the hanger 15 is disengaged from the hook F, the truck 13 is sensed by the limit switch LS4 upon arrival of the hanger 15 at the terminum of retreat thereof and the motor 17 is stopped, whereby one cycle is finished.

In the case where a cathode plate has already been conveyed to the discharging position on the first conveyor 1 when the truck 13 retreating toward the first conveyor 1 nears said first conveyor, the head bar H of the cathode plate is directly fitted in the groove 16 of the hanger 15. Meanwhile, when at least a couple of cathode plates P including the foremost cathode plate and the rearmost cathode plate among the bunch of cathode plates shifted onto the second conveyor 2 from the hanger 15 are respectively sensed by the limit switch LS9 and limit switch LS10 simultaneously whereby a complete arrangement of a prescribed number of cathode plates P is confirmed, the motor 28 is actuated through the sensing by LS9, the second conveyor 2 is driven to advance the cathode plates P, and when the foremost cathode plate P is sensed by the limit switch LS11, the motor 28 is stopped thereby bringing the second conveyor 2 to a halt. On this occasion, the rearmost cathode plate P is positioned at a prescribed distance beyond the limit switch LS10. When another bunch of cathode plates P is newly put on the second conveyor 2 in the next cycle of the shifting means 3, the foremost cathode plate P comes to be positioned at a prescribed distance behind the rearmost cathode plate P of the preceding bunch of cathode plates P and the whole cathode plates of the preceding and succeeding bunches come to be put on the second conveyor 2 at a fixed pitch.

A bunch of cathode plates shifted onto the second conveyor 2 are sensed by the limit switches LS9, LS10 in the same way as described above and undergo an inspection of the number of cathode plates thereby, the motor 28 is actuated through the sensing by the limit switch LS9, whereby the second conveyor 2 is driven, the cathode plates are advanced, and when the limit switch LS12 senses the foremost cathode plate P, the motor 28 is stopped, the second conveyor 2 is brought to a halt and, at the same time, the hoist 31 is actuated, whereby plural number of cathode plates P (which is usually equivalent to half the number of cathode plates set in the electrolytic cell) as put on the second conveyor 2 by the shifting means 3 in two rounds of transfer are discharged, suspended and conveyed, and are returned to the electrolytic cell.

The length of the second conveyor 2 is designed to be sufficient for receiving a plurality of cathode plates P equivalent to 3 rounds of transfer by the shifting means 3: even in the case where the hoist 31 is in abeyance according to the conditions on the part of the electrolytic cell and the foremost cathode plate P on the second conveyor 2 is being sensed by the limit switch LS12, the next cycle of the shifting means 3 is carried out in the same mode of operation as in the foregoing. When a plurality of cathode plates P equivalent to 3 rounds of transfer by the shifting means 3 are put on the second conveyor 2 at regular intervals and they are being sensed by all the limit switches LS9 – LS12, the cylinder 14 of the shifting means 3 is not actuated even when the cathode plates are sensed by the limit switch LS3 on the first conveyor 1, and the hanger 15 is kept standing by at the position L1 where it has received a prescribed number of cathode plates.

As soon as a plurality of cathode plates equivalent to 2 rounds of transfer by the shifting means 3 on the second conveyor 2 are discharged by the hoist 31 and go outside the range of sensing by the limit switches LS11, LS12, the second conveyor 2 advances, the remaining bunch of cathode plates put on the rear part of the second conveyor 2 are advanced, and when the limit switch LS11 senses this, the second conveyor 2 stops. Also, when the remaining bunch of cathode plates advance along the second conveyor 2 and go outside the range of sensing by the limit switch LS10, the cylinder 14 is actuated to elevate the hanger 15, the truck 13 advances up to the terminum of advance thereof and stops there. Then, upon confirming the second conveyor 2 is in abeyance, the hanger 15 is made to descend and put the cathode plates P on the second conveyor 2.

According to an apparatus as above, the cathode plates which have been received by the first conveyor one by one are arranged at regular intervals and conveyed to the discharging position with the actuation of the first conveyor by the first sensor; when the first sensor senses the arrival of the cathode plate at the discharging position, a hanger is actuated to suspend a bunch of cathode plates consisting of a plurality of cathode plates arranged at regular intervals and transfer them onto the second conveyor; when the sensor senses this transfer, it actuates the second conveyor so as to dispose the rearmost one of the cathode plates put on the second conveyor to be at a prescribed distance in front of the supplying position; and consequently, the foremost one of the bunch of cathode plates to be next transferred onto the second conveyor comes to be positioned at a prescribed distance behind said rearmost one of the preceding bunch of cathode plates on the second conveyor, so that the cathode plates of the preceding bunch and the cathode plates of the succeeding bunch can be arranged at regular intervals on the whole. Therefore, application of this apparatus on the occasion of arranging the cathode plates being conveyed after having the electrodeposited metal plate peeled off so as to be suited for setting in an electrolytic cell will bring on a superb operational effect such that, not only the cathode plates can be automatically arranged on the second conveyer at regular intervals suitable for setting in the electrolytic cell, but also it is rendered possible to simply absorb the fluctuations of the quantity of the supply of cathode plates arising from the conditions of the electrodeposited metal plate peeling-off process and the fluctuations of the quantity of the discharge of cathode plates arising from the conditions on the part of the operation of electrolysis through mere adjustment of the load of the first and the second conveyors and to perform the transfer of cathode plates stably at all times.

What is claimed is:

1. An apparatus for transferring cathode plates, which comprises: a first conveyor which is for the purpose of conveying a bunch of cathode plates consisting of a plural number of cathode plates arranged at regular intervals upon receiving them on the rear end thereof; a second conveyor which is so disposed as to make its rear end confront the fore end of the first conveyor and is for the purpose of conveying said bunch of cathode plates consisting of a plural number of cathode plates arranged at regular intervals upon receipt thereof and sending them out one at a time from the fore end thereof; a shifting means which is devised to be capable of reciprocating between above the cathode plate discharging position in the fore end portion of the first conveyor and above the cathode plate supplying position in the rear end portion of the second conveyor and is equipped with a hanger provided on the lower part thereof thereby to hang up a bunch of cathode plates consisting of plural number of cathode plates arranged at regular intervals from said discharging position on the first conveyor and transfer them to said supplying position on the second conveyor; the first sensor which senses a receipt of a bunch of cathode plates by the first conveyor and actuates the first conveyor to advance said bunch of cathode plates up to the discharging position; a second sensor which senses the arrival of a bunch of cathode plates suspended by the hanger at the discharging position; a third sensor, which senses the passage of the rearmost cathode plate of the bunch of cathode plates through the discharging position and, during a time equivalent to the time required for the advance of said cathode plate by a prescribed distance from the supplying position, moves the shifting means to a position above the supplying position to see that the suspended bunch of cathode plates be put on the supplying position on the second conveyor in the arrangement that the foremost cathode plate is disposed at a prescribed distance behind the foregoing rearmost cathode plate, and also actuates the hanger; and a fourth sensor which senses the cathode plate whenever it is taken out of the fore end portion of the second conveyor one by one, and intermittently actuates the second conveyor at regular intervals.

2. An apparatus for transferring cathode plates according to claim 1, which is devised such that, upon receiving cathode plates one by one on the rear end portion of the first conveyor, of plural number of cathode plates are conveyed at regular intervals, and a bunch of cathode plates consisting of a plural number of cathode plates are to be discharged by means of said hoist from the fore end portion of the second conveyor.

* * * * *